US007782258B2

(12) United States Patent
Lee et al.

(10) Patent No.: US 7,782,258 B2
(45) Date of Patent: Aug. 24, 2010

(54) INTEGRATED ANTENNA FOR WORLDWIDE INTEROPERABILITY FOR MICROWAVE ACCESS (WIMAX) AND WLAN

(75) Inventors: Cheng-Han Lee, Kaohsiung (TW); Ching-Chia Mai, Kaohsiung (TW); Chi-Yueh Wang, Kaohsiung (TW)

(73) Assignee: Yageo Corporation, Kaohsiung (TW)

( * ) Notice: Subject to any disclaimer, the term of this patent is extended or adjusted under 35 U.S.C. 154(b) by 103 days.

(21) Appl. No.: 12/020,695

(22) Filed: Jan. 28, 2008

(65) Prior Publication Data

US 2009/0146884 A1 Jun. 11, 2009

(30) Foreign Application Priority Data

Dec. 5, 2007 (TW) ..... 96146225 A

(51) Int. Cl.
*H01Q 1/38* (2006.01)

(52) U.S. Cl. ..... 343/700 MS; 343/702

(58) Field of Classification Search ..... 343/700 MS, 343/702, 846, 848
See application file for complete search history.

(56) References Cited

U.S. PATENT DOCUMENTS 7,450,076 B1 * 11/2008 Lin et al. ..... 343/702
2004/0233109 A1 * 11/2004 Ying et al. ..... 343/700 MS
2005/0110692 A1 * 5/2005 Andersson ..... 343/702
2007/0109202 A1 * 5/2007 Vance ..... 343/702
2007/0210969 A1 * 9/2007 Vance ..... 343/702
2007/0285321 A1 * 12/2007 Chung et al. ..... 343/702

* cited by examiner

*Primary Examiner*—HoangAnh T Le
(74) *Attorney, Agent, or Firm*—Volentine & Whitt, P.L.L.C.

(57) ABSTRACT

An integrated antenna for worldwide interoperability for microwave access (WiMax) and wireless local area network (WLAN), includes a substrate, a grounding metal strip, and first and second radiating metal strips. The first radiating metal strip is disposed on the substrate and is not connected to the grounding metal strip. The first radiating metal strip has a first portion and a second portion on two ends thereof. The first and second portions are used to induce first and second resonance modes, respectively. The second radiating metal strip is disposed on the substrate and is connected to the grounding metal strip. The second radiating metal strip is not connected to the first radiating metal strip. The energy is coupled from the second radiating metal strip to the first radiating metal strip to induce a third resonance mode. The antenna is adapted to the frequencies of WiMax and WLAN.

16 Claims, 6 Drawing Sheets

INTEGRATED ANTENNA FOR WORLDWIDE INTEROPERABILITY FOR MICROWAVE ACCESS (WIMAX) AND WLAN

BACKGROUND OF THE INVENTION

1. Field of the Invention

The present invention relates to an antenna for wireless networks, and more particularly, to an integrated antenna for Worldwide Interoperability for Microwave Access (WiMax) and Wireless Local Area Networks (WLAN).

2. Description of the Related Art

Along with the boom in wireless communication technology, various multi-frequency communication products are emerging, and thus the wireless communication products have become a normal part of human life. Almost all of the new products are provided with the wireless transmission function in order to meet the requirements of the public, for example, a data transmission function is required in a notebook computer or a multimedia device. In order to eliminate the trouble in wiring and setting, a wireless transmission antenna setting that achieves wireless transmission has become necessary.

However, the conventional antenna used in wireless communication products may only be operated at a single frequency of 2.4 GHz or a dual-frequency (2.4 GHz and 5 GHz) which fail to cover the frequencies (2.5 GHz and 3.5 GHz) required in WiMax and the frequency required in WLAN.

Therefore, it is necessary to provide an innovative and progressive integrated antenna for WiMax and WLAN to solve the above problem.

SUMMARY OF THE INVENTION

The present invention is directed to an integrated antenna for WiMax and WLAN which comprises a substrate, a grounding metal strip, a first radiating metal strip, and a second radiating metal strip. The substrate has a first surface. The first radiating metal strip is disposed on the first surface of the substrate and is not connected to the grounding metal strip. The first radiating metal strip has a first portion for inducing a first resonance mode and a second portion for inducing a second resonance mode on two ends thereof. The second radiating metal strip is disposed on the first surface of the substrate and is connected to the grounding metal strip. The second radiating metal strip is not connected to the first radiating metal strip. The energy is coupled from the second radiating metal strip to the first radiating metal strip to induce a third resonance mode.

Therefore, the integrated antenna is adapted to the frequencies (2.5 GHz and 3.5 GHz) of WiMax and the frequency of WLAN. Also, the substrate is used in the present invention as a medium having the function of reducing frequency. Moreover, the integrated antenna in the present invention is a flat planar structure, which may greatly save the space for assembling.

DETAILED DESCRIPTION OF THE INVENTION

Figure 1:
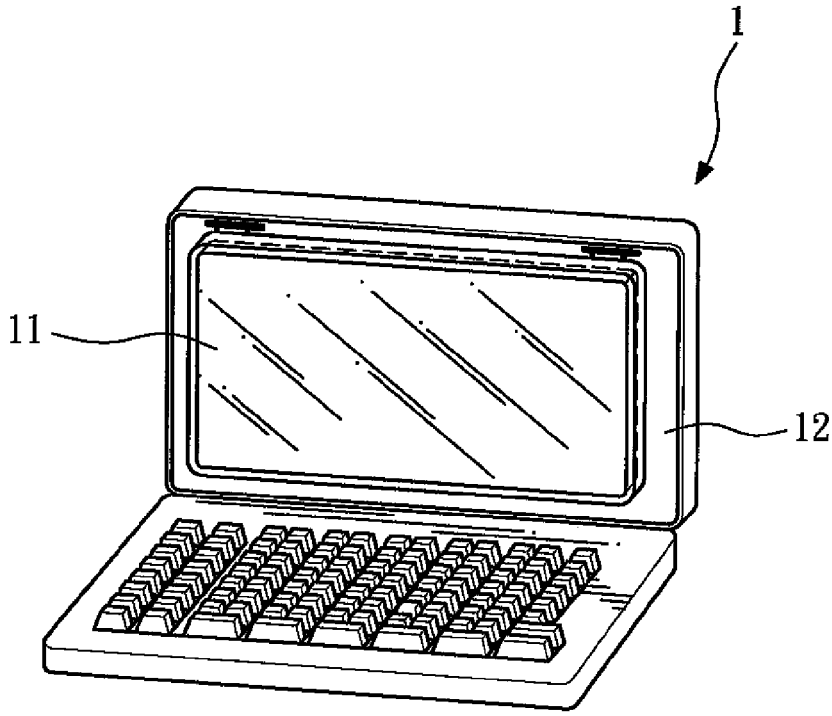
FIG. 1 is a schematic view of an antenna disposed in a screen-housing frame of a notebook computer according to the present invention.
Figure 2:
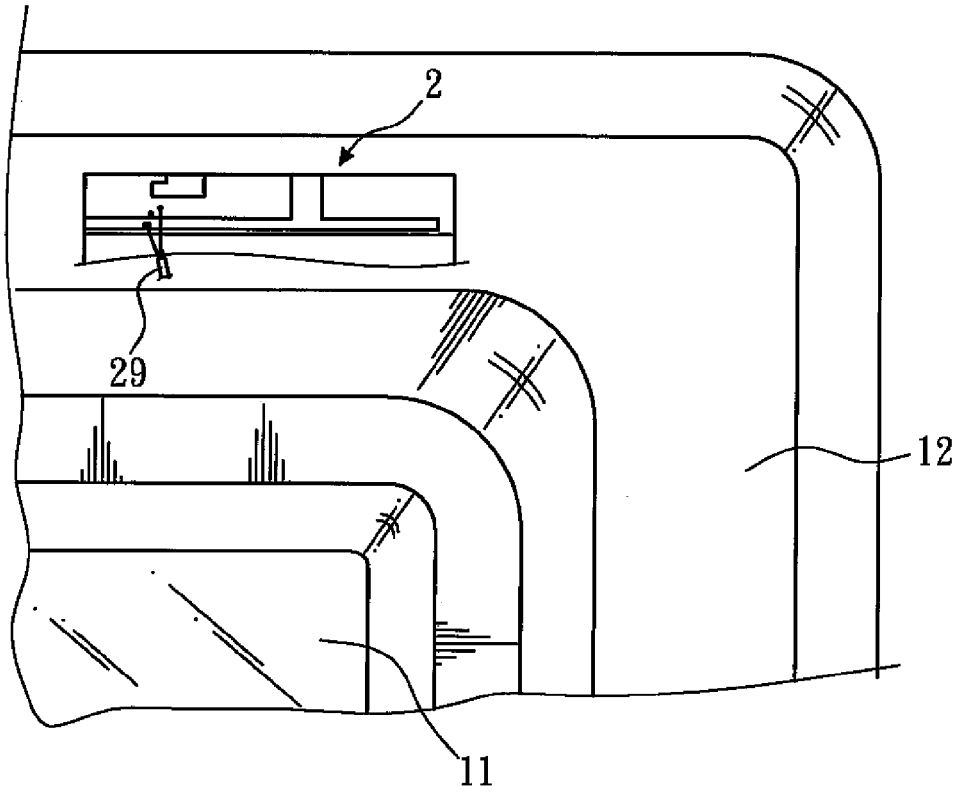
FIG. 2 is a partially enlarged schematic view of the antenna disposed in the screen-housing frame of the notebook computer according to the present invention.

FIGS. 1 and 2 show a schematic view and a partially enlarged schematic view of an antenna disposed in a screen-housing frame of a notebook computer according to the present invention respectively. The antenna of the present invention is adapted to various wireless electronic devices, including but not limited to a notebook computer, and other electronic products such as a personal digital assistant (PDA) may utilize the integrated antenna of the present invention, so as to achieve the function of wireless communication. The notebook computer 1 has a screen 11 and a screen-housing frame 12. The integrated antenna 2 of the present invention (e.g., the first embodiment, as shown in FIG. 3) is disposed on the screen-housing frame 12 of the notebook computer 1, and a coaxial cable 29 connects the integrated antenna 2 to a control circuit (not shown) of the notebook computer 1, so as to transmit data through the integrated antenna 2.

The integrated antenna 2 has at least one connecting structure for fixing the integrated antenna 2 to the screen-housing frame 12. In this embodiment, the connecting structure is an adhesive layer (not shown) located on the backside of the integrated antenna 2 for adhering the integrated antenna 2 to the screen-housing frame 12.

Figure 3:
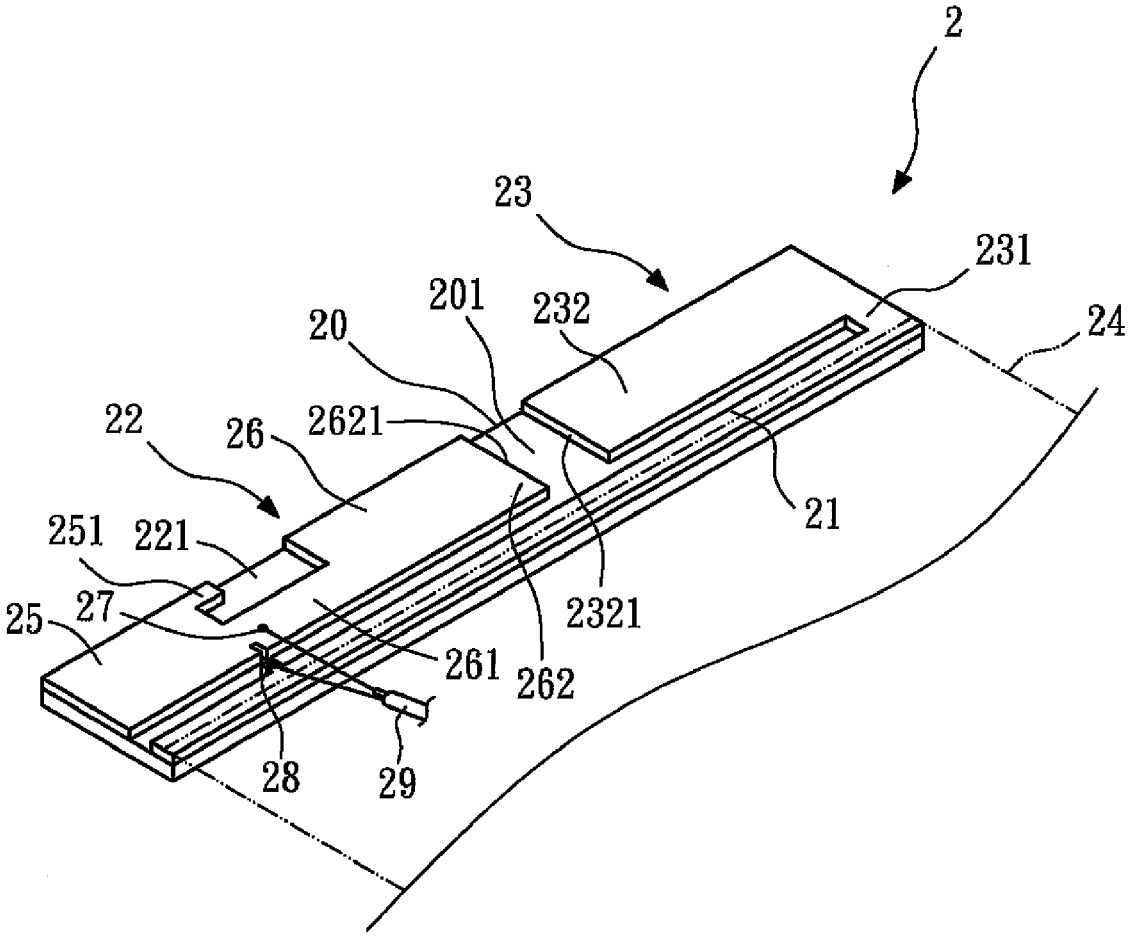
FIG. 3 is a schematic view of an integrated antenna for WiMax and WLAN according to a first embodiment of the present invention.

FIG. 3 shows a schematic view of an integrated antenna for WiMax and WLAN according to a first embodiment of the present invention. The integrated antenna 2 comprises a substrate 20, a grounding metal strip 21, a first radiating metal strip 22 and a second radiating metal strip 23. The substrate 20 has a first surface 201, and the material of the substrate 20 may be selected from a group consisting of plastic, foamed plastic, ceramic, FR-4, printed circuit board (PCB) and Flexible PCB. A dielectric constant of the substrate 20 is preferably higher than those of the first radiating metal strip 22 and the second radiating metal strip 23, so as to achieve the function of reducing the frequency.

The grounding metal strip 21 is used to ground. In this embodiment, an auxiliary grounding metal strip 24 adhered to the grounding metal strip 21 is further provided. The auxiliary grounding metal strip 24 may be made of aluminum foil.

The first radiating metal strip 22 is disposed on the first surface 201 of the substrate 20. The first radiating metal strip 22 is not connected to the grounding metal strip 21 and not connected to the second radiating metal strip 23. The first radiating metal strip 22 has a first portion 25 and a second portion 26 on two ends thereof. The first portion 25 is used for inducing a first resonance mode, and the second portion 26 is used for inducing a second resonance mode.

The length of the first portion 25 is smaller than that of the second portion 26, and thus the frequency of the first resonance mode is higher than that of the second resonance mode.

The frequency of the first resonance mode ranges from 4.9 GHz to 6 GHz, the frequency of the second resonance mode ranges from 3.3 GHz to 3.9 GHz.

In this embodiment, the first radiating metal strip 22 has an opening 221 for distinguishing the first portion 25 from the second portion 26. The first portion 25 is rectangular-shaped and has a first extension portion 251 extending in a first direction (to the right in the figure). The second portion 26 has a first end 261 and a second end 262. The first end 261 is connected to the first portion 25. The width of the second end 262 is larger than that of the first end 261. The second end 262 is rectangular-shaped and has a second end face 2621.

The second radiating metal strip 23 is disposed on the first surface 201 of the substrate 20 and connected to the grounding metal strip 21. The second radiating metal strip 23 is not connected to the first radiating metal strip 22, and the energy is coupled from the second radiating metal strip 23 to the first radiating metal strip 22 to induce a third resonance mode. The frequency of the third resonance mode ranges from 2.3 GHz to 2.7 GHz, which covers the frequency of WiMax and the frequency of 2.4 GHz of WLAN.

In this embodiment, the second radiating metal strip 23 has a third end 231 and a fourth end 232, and the third end 231 is connected to the is grounding metal strip 21. The fourth end 232 is perpendicular to the third end 231 and has a fourth end face 2321. The fourth end face 2321 faces the second end face 2621 of the second end 262, and is spaced from the other by a first pitch.

In this embodiment, the first end 261 of the second portion 26 of the first radiating metal strip 22 further comprises a feed-in point 27. The grounding metal strip 21 further comprises a ground point 28, and the feed-in point 27 and the ground point 28 are electrically connected to a signal end and a ground end of the coaxial cable 29 respectively.

In this embodiment, the first radiating metal strip 22 and the second radiating metal strip 23 are adhered to the first surface 201 of the substrate 20.

Therefore, the integrated antenna 2 of the present invention is adapted to the frequencies (2.5 GHz and 3.5 GHz) of WiMax and the frequency (2.4 GHz or 5 GHz) of WLAN. Also, the substrate 20 is used in the present invention as a medium having the function of reducing frequency. Moreover, the integrated antenna 2 in the present invention is a flat planar structure, which may greatly save the space for assembling.

Figure 4:
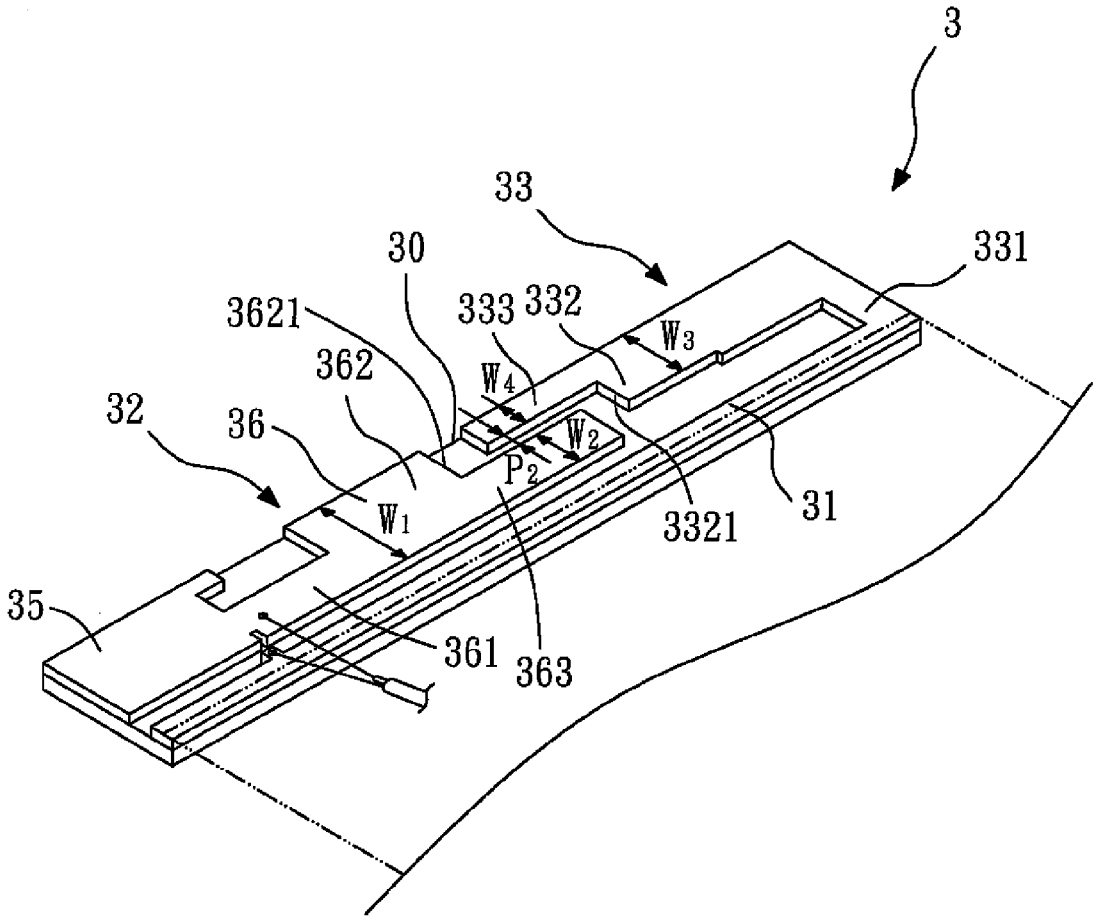
FIG. 4 is a schematic view of an integrated antenna for WiMax and WLAN according to a second embodiment of the present invention.

FIG. 4 shows a schematic view of an integrated antenna for WiMax and WLAN according to a second embodiment of the present invention. The integrated antenna 3 comprises a substrate 30, a grounding metal strip 31, a first radiating metal strip 32, and a second radiating metal strip 33. The first radiating metal strip 32 has a first portion 35 and a second portion 36 on two ends thereof. The second portion 36 has a first end 361 and a second end 362. The second end 362 is rectangular shaped, and has a second end face 3621. The second radiating metal strip 33 has a third end 331 and a fourth end 332, and the fourth end 332 has a fourth end face 3321.

The difference between the integrated antenna 3 in this embodiment and the integrated antenna 2 in the first embodiment (FIG. 3) lies in the fact that the second end 362 has a second extension portion 363 extending to a first direction (to the right in the figure) and facing the fourth end face 3321. The width $W_1$ of the second end 362 is greater than the width $W_2$ of the second extension portion 363. The fourth end 332 has a third extension portion 333 extending to a second direction (to the left in the figure) and facing the second end face 3621. The third extension portion 333 is perpendicular to the fourth end face 3321. The width $W_3$ of the fourth end 332 is greater than the width $W_4$ of the third extension portion 333. The second direction is opposite the first direction. The second extension portion 363 is parallel to the third extension portion 333, and is spaced from the other by a second pitch. In this embodiment, the second extension portion 363 is disposed below the third extension portion 333. The second pitch ranges from 0.1 mm to 5 mm.

Figure 5:
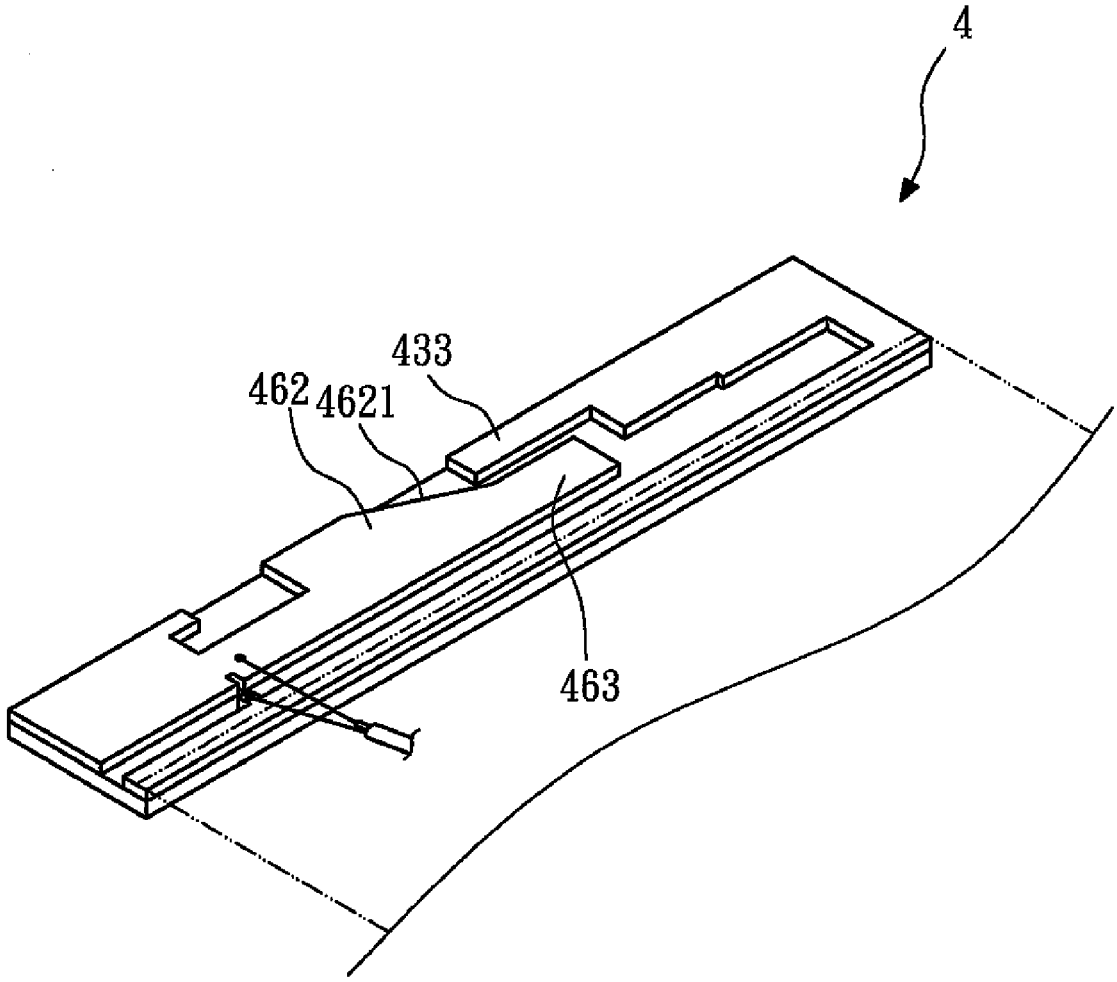
FIG. 5 is a schematic view of an integrated antenna for WiMax and WLAN according to a third embodiment of the present invention.

FIG. 5 shows a schematic view of an integrated antenna for WiMax and WLAN according to a third embodiment of the present invention. The integrated antenna 4 in this embodiment is substantially the same as the integrated antenna 3 in the second embodiment (FIG. 4), except that a second end face 4621 of a second end 462 is an inclined plane, i.e., an angle between the second end face 4621 and a second extension portion 463 is not 90°, and the inclined plane (the second end face 4621) faces a third extension portion 433.

Figure 6:
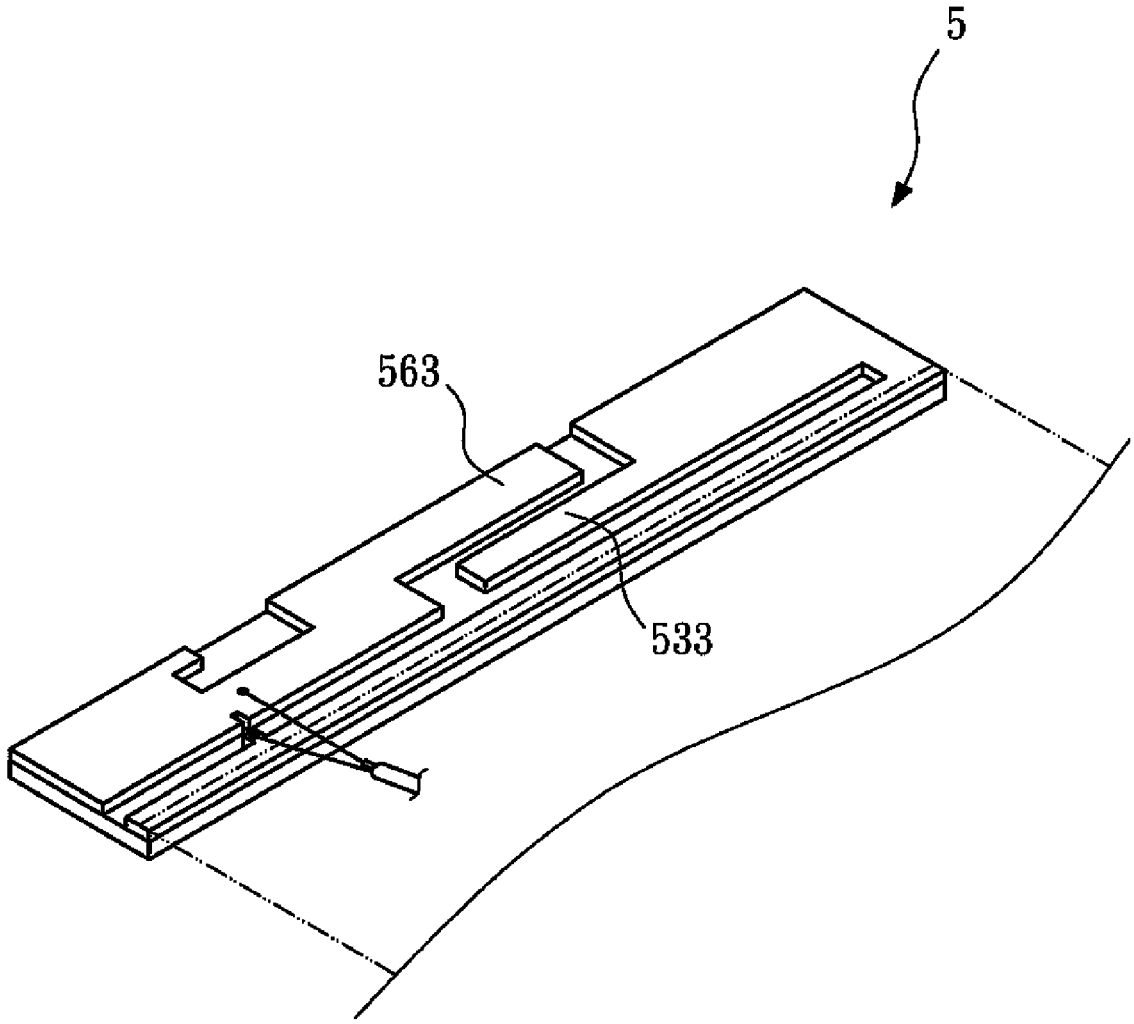
FIG. 6 is a schematic view of an integrated antenna for WiMax and WLAN according to a fourth embodiment of the present invention.

FIG. 6 shows a schematic view of an integrated antenna for WiMax and WLAN according to a fourth embodiment of the present invention. The integrated antenna 5 in this embodiment is substantially the same as the integrated antenna 3 in the second embodiment (FIG. 4), except that in this embodiment, a second extension portion 563 is disposed above a third extension portion 533.

Figure 7:
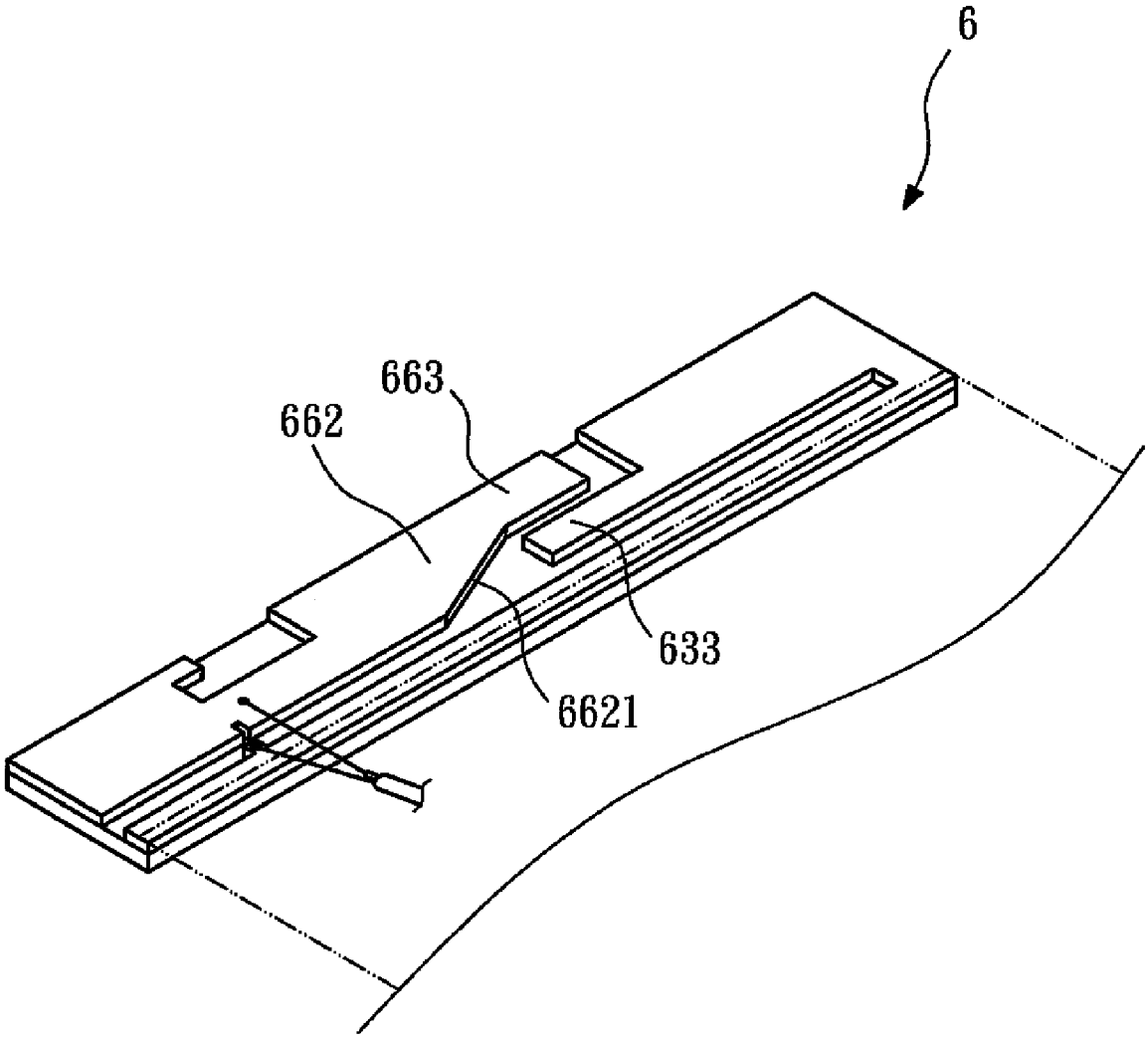
FIG. 7 is a schematic view of an integrated antenna for WiMax and WLAN according to a fifth embodiment of the present invention.

FIG. 7 shows a schematic view of an integrated antenna for WiMax and WLAN according to a fifth embodiment of the present invention. The integrated antenna 6 in this embodiment is substantially the same as the integrated antenna 5 in the fourth embodiment (FIG. 6), except that a second end face 6621 of a second end 662 is an inclined plane, i.e., an angle between the second end face 6621 and a second extension portion 663 is not 90°, and the inclined plane (the second end face 6621) faces a third extension portion 633.

While several embodiments of the present invention have been illustrated and described, various modifications and improvements can be made by those skilled in the art. The embodiments of the present invention are therefore described in an illustrative but not restrictive sense. It is intended that the present invention should not be limited to the particular forms as illustrated, and that all modifications which maintain the spirit and scope of the present invention are within the scope defined in the appended claims.

What is claimed is:

1. An integrated antenna for worldwide interoperability for microwave access (WiMax) and wireless local area network (WLAN), comprising:

a substrate, having a first surface;

a grounding metal strip;

a first radiating metal strip, disposed on the first surface of the substrate and not connected to the grounding metal strip, wherein the first radiating metal strip has a first portion for inducing a first resonance mode and a second portion for inducing a second resonance mode on two ends thereof, the second portion has a first end and a second end, the first end is connected to the first portion, the second end has a second end face and a second extension portion extending in a first direction, the width of the second end is greater than that of the second extension portion; and a second radiating metal strip, disposed on the first surface of the substrate and connected to the grounding metal strip, wherein the second radiating metal strip is not connected to the first radiating metal strip, the energy is coupled from the second radiating metal strip to the first radiating metal strip to induce a third resonance mode, the second radiating metal strip has a third end and a fourth end, the third end is connected to the grounding metal strip, the fourth end is perpendicular to the third end, the fourth end has a fourth end face and a third extension portion extending in a second direction opposite the first direction, the third extension portion is perpendicular to the fourth end face, the width of the fourth end is greater than that of the third extension portion, the third extension portion faces the second end face, the second extension portion faces the fourth end face, and the second extension portion is parallel to the third extension portion and is spaced from the third extension portion by a pitch.

2. The integrated antenna according to claim 1, wherein the material of the substrate is selected from a group consisting of plastic, foamed plastic, ceramic, FR-4, printed circuit board (PCB), and Flexible PCB.

3. The integrated antenna according to claim 1, wherein a dielectric constant of the substrate is higher than those of the first radiating metal strip and the second radiating metal strip.

4. The integrated antenna according to claim 1, wherein the first radiating metal strip and the second radiating metal strip are adhered to the first surface of the substrate.

5. The integrated antenna according to claim 1, wherein the frequency of the first resonance mode ranges from 4.9 GHz to 6 GHz, the frequency of the second resonance mode ranges from 3.3 GHz to 3.9 GHz, and the frequency of the third resonance mode ranges from 2.3 GHz to 2.7 GHz.

6. The integrated antenna according to claim 1, further comprising an auxiliary grounding metal strip adhered to the grounding metal strip.

7. The integrated antenna according to claim 1, wherein the first radiating metal strip has an opening for distinguishing the first portion from the second portion.

8. The integrated antenna according to claim 1, wherein the first portion is rectangular shaped.

9. The integrated antenna according to claim 1, wherein the first portion further has a first extension portion extending in a first direction.

10. The integrated antenna according to claim 1, wherein a length of the first portion is smaller than that of the second portion.

11. The integrated antenna according to claim 1, wherein a width of the second end is larger than that of the first end.

12. The integrated antenna according to claim 1, wherein the second end is rectangular shaped.

13. The integrated antenna according to claim 1, wherein the second extension portion is disposed above the third extension portion.

14. The integrated antenna according to claim 1, wherein the second extension portion is disposed below the third extension portion.

15. The integrated antenna according to claim 1, wherein the second end further has an inclined plane facing the third extension portion.

16. The integrated antenna according to claim 1, wherein the first radiating metal strip further comprises a feed-in point, the grounding metal strip further comprises a ground point, and the feed-in point and the ground point are electrically connected to a signal end and a ground end of a coaxial cable respectively.

* * * * *